US006971815B1

(12) United States Patent
Cruz

(10) Patent No.: US 6,971,815 B1
(45) Date of Patent: Dec. 6, 2005

(54) BINDER RING CLAMP ASSEMBLY

(76) Inventor: Pol Cruz, 159 S. Van Ness Ave., Los Angeles, CA (US) 90004

( * ) Notice: Subject to any disclaimer, the term of this patent is extended or adjusted under 35 U.S.C. 154(b) by 29 days.

(21) Appl. No.: 10/853,965

(22) Filed: May 26, 2004

Related U.S. Application Data

(60) Provisional application No. 60/477,090, filed on Jun. 9, 2003.

(51) Int. Cl.[7] ..... B42F 3/00

(52) U.S. Cl. ..... 402/70; 402/8; 402/19; 402/73; 281/21.1

(58) Field of Search ..... 402/8, 19, 26, 402/31, 35, 37, 38, 70, 73; 281/21.1, 27.1; 24/67 R

(56) References Cited

U.S. PATENT DOCUMENTS 1,817,488 A * 8/1931 Irving ..... 402/31
1,818,999 A * 8/1931 Murphy ..... 402/38
2,486,329 A * 10/1949 Schade ..... 402/80 L
3,205,895 A * 9/1965 Johnson ..... 402/38
3,306,301 A * 2/1967 Mason ..... 402/38
5,697,722 A * 12/1997 Hladik et al. ..... 402/35

* cited by examiner

*Primary Examiner*—Boyer D. Ashley
*Assistant Examiner*—J Williams
(74) *Attorney, Agent, or Firm*—Goldstein Law Offices, PC.

(57) ABSTRACT

A binder ring clamp assembly for use with a loose leaf binders having binder rings. The assembly has a pair of clamps, each clamp having a flat panel with at least two holes for allowing the binder rings to extend therethrough. Tensioned springs are secured around the holes such that in use the springs are extended over the binder rings. The springs serve to urge the paper contained within the rings towards the center of the rings. When the binder is closed, the springs are compressed between the binder rings and the clamp assembly panels. The tension in the springs, along with the weight of the panels, exert pressure against the papers from both directions to maintaining the papers in alignment and positioned towards the center of the binder.

3 Claims, 2 Drawing Sheets

BINDER RING CLAMP ASSEMBLY

CROSS REFERENCES AND RELATED SUBJECT MATTER

This application is a continuation of provisional patent application Ser. No. 60,477,090, filed in the United States Patent Office on Jun. 9, 2003.

BACKGROUND OF THE INVENTION

The invention relates to a binder ring clamp assembly. In particular, the invention is a clamp assembly that is utilized with a loose leaf binder in order to maintain the papers in alignment and urge said papers towards the center of the binder.

Looseleaf binders are used by people of all ages and for various reasons to hold loose sheets of paper together. Binders are especially popular with students, teachers, accountants, and other individuals who need to keep track of loose papers. The binder allows the user to organize papers in a neat and orderly fashion for quick reference. While binders are especially helpful for containing loose sheets of paper, the binders are often cumbersome and have a tendency of clustering and skewing papers contained therein around the binder rings. Upon opening the binder, it is often necessary to rearrange the papers around the rings before the user can access the needed paper. Once the papers are properly aligned towards the center of the rings, the user may then flip through the papers in order to find a particular page.

Thus, there exists a need for a binder ring clamp assembly that is quickly and easily mated with the binder rings of existing loose leaf binders and serves to maintain the papers contained within the binder in an aligned fashion towards the center of the binder. The clamp assembly is mated with the binder rings and urges the papers away from the binder covers and towards the middle of the binder.

U.S. Pat. No. 3,758,219 to Stasio et al. discloses a loose leaf notebook sheet lifter for lifting and turning the pages of the notebook and preventing the pages from getting caught and torn by the notebook rings. U.S. Pat. No. 3,591,300 to Beyer discloses a universal sheet lifter having two parts, each part mateable with the binder ring and flexibly interconnected across the ring to maintain an alignment while permitting pivoting with the binder covers. U.S. Pat. No. 4,573,822 to Allen discloses a sheet lifter for a looseleaf binder used with a ring binder so that the pages in the binder do not bind under the rings of the binder when the binder is closed.

While these units may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved binder ring clamp assembly. As such, the general purpose of the present invention, which will be described subsequently in greater detail, is to provide a new and improved binder ring clamp assembly which has all the advantages of the prior art and none of the disadvantages.

To attain this, the present invention essentially comprises a binder ring clamp assembly for use with a loose leaf binder having binder rings. The assembly has a pair of clamps made up of two flat panels, each panel having at least two holes extending therethrough. Tensioned springs are secured to the holes and the springs extend over the binder rings as the binder rings extend through the holes. The springs serve to urge the paper contained within the rings towards the center of the rings. When the binder is closed, the springs are compressed between the binder rings and the clamp assembly panels. The tension in the springs, along with the weight of the panels, exert pressure against the papers from both directions to maintaining the papers in alignment and positioned towards the center of the binder.

It is an object of the invention to produce a binder ring clamp assembly that is used with loose leaf binders to align the papers contained therein and urge the papers towards the center of the binder. Accordingly, the binder clamp assembly has a pair of flat panels and a plurality of springs attached thereto. The springs extend around the binder rings and serve to exert pressure against the papers to urge said papers toward the center of the binder rings.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMBERALS

Figure 1:
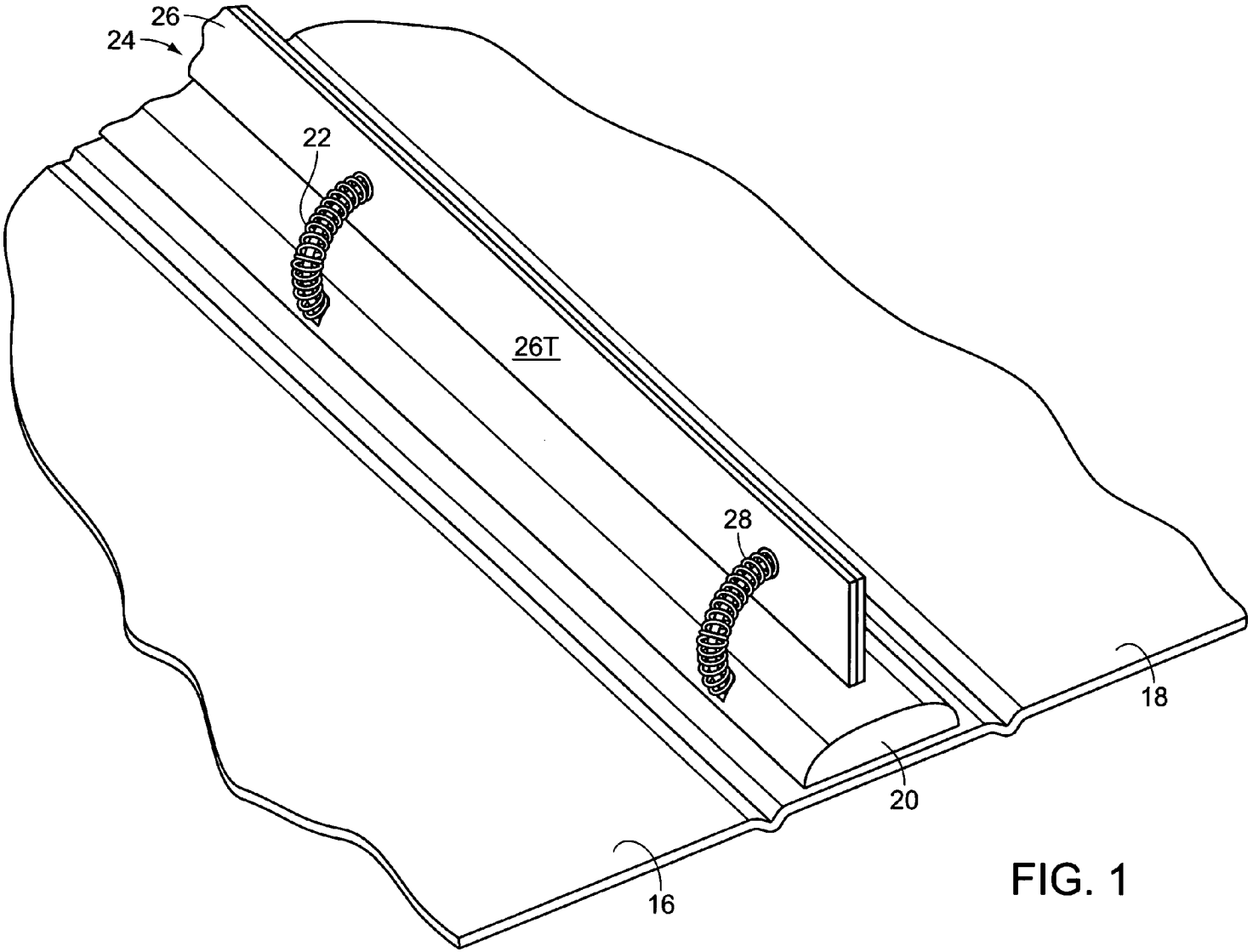
FIG. 1 is a diagrammatic perspective view of a portion of a loose leaf binder, illustrating one of the clamps positioned in the binder.
Figure 2:
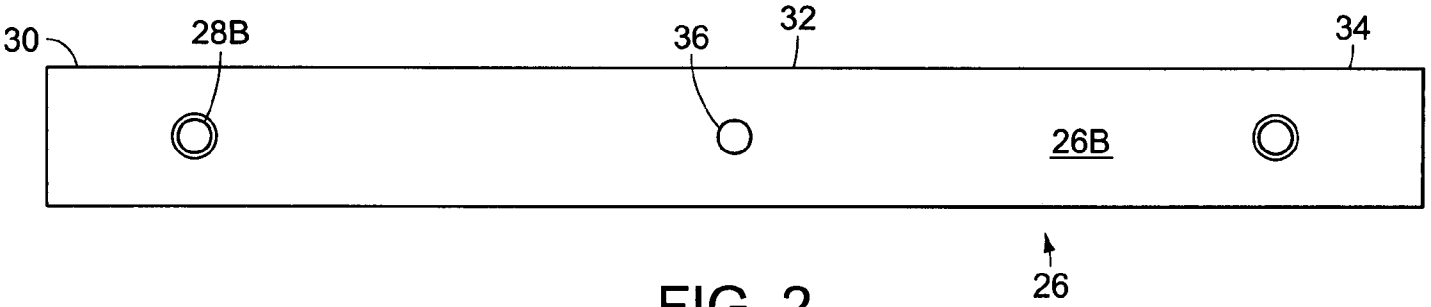
FIG. 2 is a bottom elevational view of one of the panels which form the clamp in the binder ring clamp assembly.
Figure 3:
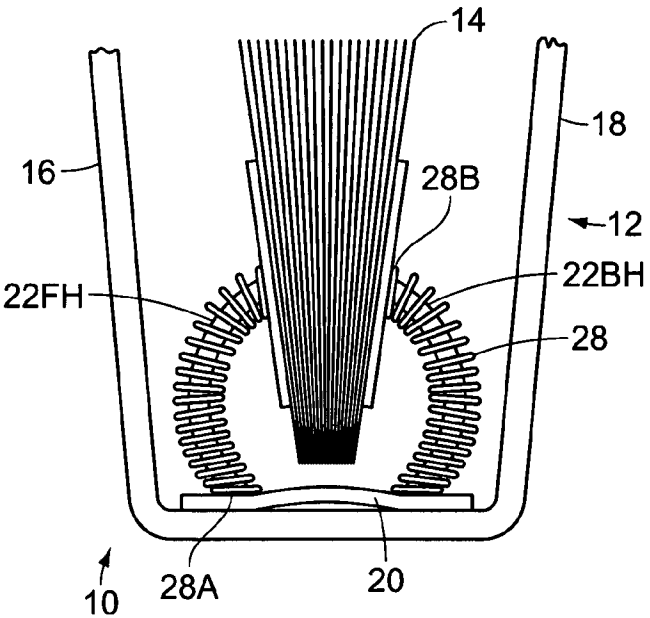
FIG. 3 is a front elevational view of the binder ring clamp assembly mated with a loose leaf binder, illustrating the clamp assembly exerting pressure against the pages contained in the binder in order to urge the papers towards the center of the binder.

10 binder ring clamp assembly
12 loose leaf binder
14 paper
16 binder front cover
18 binder back cover
20 binder base
22 binder ring
22H ring half
22FH ring front half
22BH ring back half
24 clamp
26 clamp panel
26T panel top surface
26B panel bottom surface
28 spring
28A spring base end
28B spring panel end
30 panel top portion
32 panel bottom portion
34 panel middle portion
36 panel hole

DETAILED DESCRIPTION OF THE PREFERRED EMBODIMENTS

FIG. 1 illustrates a binder ring clamp assembly 10 for use with a loose leaf binder 12. The loose leaf binder 12 has a front cover 16, a back cover 18, a base 20 positioned between the covers 16, 18, and a plurality of rings 22 fixedly secured to the base 20. The rings 22 are selectively openable in order to allow pages of paper 14 having punched holes corresponding to the rings 22 to be inserted thereon. When opened, each ring 22 is divided into two ring halves 22H, namely a ring front half 22FH and a ring back half 22BH, each half 22H positioned adjacent to one of the covers 16, 18. Such binders 12 exist in various forms. In particular, some binders 12 have two rings 22, while others have three and even five rings.

The binder ring clamp assembly 10 essentially comprises a pair of clamps 24, each clamp 24 having a panel 26 and at least two springs 28 fixedly attached to said panel 26. Each panel 26 has a top surface 26T, a bottom surface 26B, a top portion 30, a bottom portion 32, and a middle portion 34 positioned therebetween. A plurality of holes 36 extend through the panel 26 from the top surface 26T to the bottom surface 26B, said holes 36 corresponding to the positioning of the binder rings 22. Each clamp 24 has at least two such holes 36, one hole 36 positioned at the panel top portion 30 and one hole 36 positioned at the panel bottom portion 32. Such a configuration of two holes 36 would be best suited for use with a two ring binder 12. Additionally, the panel 26 may have a third hole 36 positioned in the middle portion 34, for use with a three ring binder 12.

The panel 26 is constructed from a durable material, preferably a thin metal or plastic. Further, the size of the panel 26 corresponds to the size of the binder 12 in which said panel 26 is to be used.

Each spring 28 has a base end 28A and a panel end 28B, wherein the panel end 28B of each spring is fixedly attached to the panel top surface 26T, around one of the panel holes 36. Each spring 28 extends outward from the panel 26 and is sized to extend concentrically over the corresponding ring half 22H. The number of springs 280 fixed to the panel 26 corresponds to the number of rings 22 in the binder 12. Each spring 28 is preferably a high tensile coiled spring in order to best facilitate the ultimate goal of urging the papers 14 contained within the rings 22 towards the center, as will be described hereinafter.

In use, the correct sized panel 26, having the appropriate number of springs 28 which match the positioning of the binder rings, is chosen according to the binder 12. The binder front cover 16 is opened in order to reveal the rings 22 contained between the front and back covers 16, 18. The rings 22 are each opened, thereby creating the ring halves 22H. Before the paper 14 is mated with the ring halves 22H, one of the panels 26 is mated with the ring front half 22FH by extending its the springs 28 over the corresponding ring halves 22H, leading with the spring base end 28A. The second panel 26 is similarly mated with the ring back halves 22BH. The paper 14 is then inserted onto the ring halves 22H, and the rings 22 are closed, thereby securing the clamps 24 and the paper 14 therebetween.

The springs 28 are tensioned against the base 20 and bias the panels 26 toward each other, and thereby serve to urge the paper 14 on the rings 22 between the panels 26 towards the center of the rings 22. This configuration enables a user to easily close the binder 12 without having to readjust the paper 14 before closing. Thus, when the binder 12 is closed, the springs 28 are compressed between the binder rings 22 and the clamp assembly panels 26. The tension in the springs 18 against the panels 26, exerts pressure against the papers 14 from both a forward direction and a rearward direction, thereby maintaining the papers 14 in alignment and positioned towards the center of the binder rings 22.

In conclusion, herein is presented a binder ring clamp assembly that is easily installed onto a standard loose leaf binder to align the papers held in the binder, as well as position the papers towards the center of the rings of said binder. The invention is illustrated by example in the drawing figures, and throughout the written description. It should be understood that numerous variations are possible, while adhering to the inventive concept. Such variations are contemplated as being a part of the present invention.

What is claimed is:

1. A binder ring clamp assembly, for holding paper, comprising:

a binder for use with a loose leaf binder having a front cover, back cover, and base between the front cover and back cover;

a plurality of binder rings, each binder ring having a ring front half, extending from the base near the front cover, a ring back half, extending from the base near the rear cover, the ring front half of each binder ring selectively engaging the ring back half to selectively extend through and hold papers together and selectively allow papers to be inserted and removed therefrom;

a clamp, having a pair of clamp panels, each clamp panel having a panel bottom surface and a panel top surface opposite therefrom, each clamp panel has a panel hole corresponding with each binder ring, for allowing the rings to extend therethrough, such that the ring front halves extend through one of the clamp panels and the ring back halves extend through the other of the clamp panels of the clamp; and at least two springs, including at least one spring associated with one of the ring front halves and at least one spring associated with one of the ring back halves, each spring extends outwardly from the panel and is sized to extend concentrically over its associated ring half, each spring having a base end and a panel end, the panel end attached to one of the clamp panels, the springs urging the clamp panels toward each other so that when pages are held by the binder rings, they are held in a centered position on the rings by the clamp panels.

2. The binder clamp assembly as recited in claim 1, wherein the binder has three rings, each having a ring front half and ring back half, and wherein each clamp panel has three holes that are spaced to correspond with the rings.

3. The binder clamp assembly as recited in claim 1, having three pairs of springs, each pair of springs associated with one of the rings.

* * * * *